US006235704B1

(12) United States Patent
Detering et al.

(10) Patent No.: US 6,235,704 B1
(45) Date of Patent: May 22, 2001

(54) SOLID TEXTILE DETERGENT FORMULATION BASED ON GLYCIN-N AND N-DIACETIC ACID DERIVATIVES

(75) Inventors: Jürgen Detering, Limburgerhof; Richard Baur, Mutterstadt; Werner Bertleff, Viernheim; Rainer Rahm, Ludwigshafen; Günter Oetter, Frankenthal, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/463,576

(22) PCT Filed: Jul. 20, 1998

(86) PCT No.: PCT/EP98/04484

§ 371 Date: Jan. 28, 2000

§ 102(e) Date: Jan. 28, 2000

(87) PCT Pub. No.: WO99/06524

PCT Pub. Date: Feb. 11, 1999

(30) Foreign Application Priority Data

Jul. 30, 1997 (DE) ..... 197 32 688
Feb. 20, 1998 (DE) ..... 197 07 104

(51) Int. Cl.[7] ..... C11D 3/30; C11D 7/12; C11D 7/14

(52) U.S. Cl. ..... 510/480; 510/509; 510/485; 510/531; 510/532; 510/533; 510/534; 510/276; 510/289; 510/300; 510/315; 510/334; 510/367; 510/377; 510/443; 510/444; 510/507; 510/511

(58) Field of Search ..... 510/489, 509, 510/485, 531, 532, 533, 534, 276, 289, 300, 315, 334, 367, 377, 443, 444, 507

(56) References Cited

U.S. PATENT DOCUMENTS

| | | | | |
|---|---|---|---|---|
| 4,604,224 | | 8/1986 | Cheng | 252/91 |
| 5,227,446 | | 7/1993 | Denzinger et al. | 527/314 |
| 5,399,286 | | 3/1995 | Funhoff et al. | 252/174.23 |
| 5,481,018 | | 1/1996 | Athey et al. | 558/442 |
| 5,506,332 | | 4/1996 | Funhoff et al. | 528/232 |
| 5,616,547 | | 4/1997 | Ponce et al. | 510/230 |
| 5,756,456 | | 5/1998 | Ho et al. | 514/12 |
| 5,786,313 | * | 7/1998 | Schnieder et al. | 510/219 |
| 5,804,541 | * | 9/1998 | Jans | 510/214 |
| 5,817,864 | * | 10/1998 | Greindl et al. | 560/171 |
| 5,968,884 | * | 10/1999 | Gopalkrishnan et al. | 510/361 |
| 5,994,290 | * | 11/1999 | Potthoff-Karl et al. | 510/531 |

FOREIGN PATENT DOCUMENTS

| | | | |
|---|---|---|---|
| 41 06 355 | | 9/1992 | (DE) . |
| 43 13 909 | | 11/1994 | (DE) . |
| 43 19 935 | | 12/1994 | (DE) . |
| 44 15 623 | | 11/1995 | (DE) . |
| 0 001 004 | | 3/1979 | (EP) . |
| 0 021 491 | | 1/1981 | (EP) . |
| 0 038 591 | | 10/1981 | (EP) . |
| 0 087 035 | | 8/1983 | (EP) . |
| 0 384 070 | | 8/1990 | (EP) . |
| 0 454 126 | | 10/1991 | (EP) . |
| 511 037 | | 10/1992 | (EP) . |
| 0 522 726 | | 1/1993 | (EP) . |
| 0 581 452 | | 2/1994 | (EP) . |
| 0 656 914 | | 4/1996 | (EP) . |
| 2 013 259 | | 8/1979 | (GB) . |
| 2-229849 | | 9/1990 | (JP) . |
| 10-8094 | | 1/1998 | (JP) . |
| 10-53799 | | 2/1998 | (JP) . |
| WO 94/10486 | | 5/1994 | (WO) . |
| WO 94/24251 | | 10/1994 | (WO) . |
| WO 97/19159 | | 5/1997 | (WO) . |
| 97/19159 | * | 5/1997 | (WO) . |
| WO 97/27278 | | 7/1997 | (WO) . |

* cited by examiner

*Primary Examiner*—Yogendra Gupta
*Assistant Examiner*—Charles Boyer
(74) *Attorney, Agent, or Firm*—Oblon, Spivak, McClelland, Maier & Neustadt, P.C.

(57) ABSTRACT

A solid textile detergent formulation comprises (A) from 1 to 30% by weight of inorganic builders based on carbonates, (B) from 0 to 12% by weight of inorganic builders based on crystalline or amorphous alumosilicates and/or crystalline or amorphous silicates, (C) from 0 to 5% by weight of inorganic builders based on phosphates, (D) from 1 to 40% by weight of one or more glycine-N, N-diacetic acid derivatives I (I)

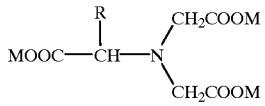

where R is an organic radical and M is hydrogen or a cation, as organic builder component, (E) from 0 to 40% by weight of anionic surfactants and (F) from 0.5 to 50% by weight of nonionic surfactants.

14 Claims, No Drawings

SOLID TEXTILE DETERGENT FORMULATION BASED ON GLYCIN-N AND N-DIACETIC ACID DERIVATIVES

The present invention relates to a solid textile detergent formulation comprising carbonate-based inorganic builders (possibly with a small amount of silicate and phosphate builders), glycine-N,N-diacetic acid derivatives as organic builder components and also surfactants and, if desired, further customary constituents.

Inorganic silicon-containing builders, such as alumosilicates (zeolites) or silicates, are essential constituents of conventional reduced-phosphate or phosphate-free powder detergents. Their content is usually from 10 to 45% by weight. Their primary purpose in the washing process is to reduce water hardness, as a result of which the washing performance, specifically of the anion surfactants, is increased and at the same time the extent of fabric deposits (incrustations), consisting of insoluble calcium salts and magnesium salts, is reduced. In the case of builders which are insoluble or partially soluble in the wash water (eg. zeolites, crystalline sheet silicates), there is in principle, however, the danger that builder particles are deposited on the fabric and thus contribute to incrustation. Water-soluble inorganic silicate builders (eg. amorphous disilicates) do not act as ion exchangers as the zeolites do, but precipitate the calcium ions and magnesium ions as insoluble silicates. Again, there is the danger of fabric incrustation by silicate. Furthermore, the insoluble builders make a not inconsiderable contribution to the amount of sludge produced in waste treatment plants.

Use of biodegradable glycine-N,N-diacetic acid derivatives allows the content of such inorganic builders to be greatly reduced and at the same time the detergency to be increased. In particular, the formation of fabric incrustations is advantageously inhibited. In addition, the total content of biodegradable components in the detergent formulation increases, as does the overall solubility of the detergent. Furthermore, by reducing the amount of inorganic builders, it is possible to prepare particularly highly concentrated compact solid detergent formulations having a distinctly reduced volume.

WO-A 97/19159 has already disclosed the use of said glycine-N,N-diacetic acid derivatives in solid textile detergent formulations. This patent describes solid textile detergent formulations comprising from 1 to 60% by weight of inorganic builders based on silicates, carbonates and phosphates, the silicate content being from 13 to 36% by weight.

It is an object of the present invention to provide a solid textile detergent formulation in which the content of inorganic builders based on alumosilicates and/or silicates is greatly reduced.

We have found that this object is achieved by a solid textile detergent formulation which comprises (A) from 1 to 30% by weight of inorganic builders based on carbonates, (B) from 0 to 12% by weight of inorganic builders based on crystalline or amorphous alumosilicates and/or crystalline or amorphous silicates, (C) from 0 to 5% by weight of inorganic builders based on phosphates, (D) from 1 to 40% by weight of one or more glycine-N, N-diacetic acid derivatives of the formula I (I)

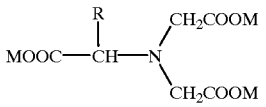

where

R is $C_1$- to $C_{30}$-alkyl or $C_2$- to $C_{30}$-alkenyl each of which is unsubstituted or substituted by up to 5 hydroxyl, sulfate, sulfonate, formyl, $C_1$- to $C_4$-alkoxy, phenoxy or $C_1$- to $C_4$-alkoxycarbonyl groups, and may be interrupted by up to 5 nonadjacent oxygen and/or nitrogen atoms, R is furthermore alkoxylate of the formula $—(CH_2)_k—O—(A^1O)_m—(A^2O)_n—Y$, where $A^1$ and $A^2$, independently of one another, are 1,2-alkylene having from 2 to 4 carbon atoms, Y is hydrogen, $C_1$- to $C_{12}$-alkyl, phenyl, $C_1$- to $C_4$-alkoxycarbonyl or sulfo, k is 1, 2 or 3, and m and n are each from 0 to 50, where the sum m+n must be at least 2, phenylalkyl having from 1 to 20 carbon atoms in the alkyl moiety, a five- or six-membered unsaturated or saturated heterocyclic ring having up to three heteroatoms from the group consisting of nitrogen, oxygen and sulfur, which may, in addition, be benzo-fused, where all the phenyl and heterocyclic rings given in the meanings for R are unsubstituted or substituted by up to three $C_1$- to $C_4$-alkyl, hydroxyl, carboxyl, sulfo or $C_1$- to $C_4$-alkoxycarbonyl groups, or is a radical of the formula

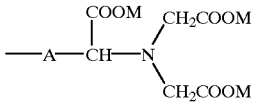

where A is a $C_1$- to $C_{12}$-alkylene bridge or a chemical bond, and

M is hydrogen, alkali metal, alkaline earth metal, ammonium or substituted ammonium in the corresponding stoichiometric quantities, as organic builder component, (E) from 0 to 40% by weight of anionic surfactants and (F) from 0.5 to 50% by weight of nonionic surfactants.

The sum of all the detergent components given above and below is at most 100% by weight, including residual quantities of water.

Suitable inorganic carbonate-based builder substances (A) are carbonates and hydrogencarbonates. These can be employed in the form of their alkali metal, alkaline earth metal or ammonium salts. Preference is given to carbonates and hydrogencarbonates of Na, Li and Mg, in particular sodium carbonate and/or sodium hydrogencarbonate.

Suitable inorganic builders (B) are in particular crystalline or amorphous alumosilicates having ion exchange properties, such as, in particular, zeolites. A variety of zeolite types are suitable, in particular zeolites A, X, B, P, MAP and HS in their Na form or in forms in which Na has partially been replaced by other cations, such as Li, K, Ca, Mg or ammonium. Suitable zeolites are described in EP-A 038 591, EP-A 021 491, EP-A 087 035, U.S. Pat. No. 4,604,224, GB-A 20 13 259, EP-A 522 726, EP-A 384 070 and WO-A 94/24251, for example.

Examples of suitable crystalline silicates (B) are disilicates or sheet silicates, eg. $\delta$-$Na_2Si_2O_5$ or $\beta$-$Na_2Si_2O_5$ (SKS 6 and SKS 7, Hoechst). The silicates can be used in the form of their alkali metal, alkaline earth metal or ammonium salts, preferably as Na, Li and Mg silicates. Amorphous silicates, for example sodium metasilicate, which has a polymeric structure, or amorphous disilicate (Britesil® H 20, Akzo) can also be used.

Phosphates which are customarily used as inorganic builders (C) are polyphosphates, for example pentasodium triphosphate.

Component (A) is preferably present in the textile detergent formulation according to the invention in an amount of from 5 to 27% by weight, in particular from 10 to 25% by weight.

Component (B) is preferably employed in amounts of from 0 to 10% by weight, in particular from 0 to 8% by weight. Good results are obtained using quantities of from 1.5 to 8% by weight, in particular from 2 to 6% by weight, of component (B) in the detergent formulation. However, the desired advantages and effects for the purposes of the present invention are also achieved if component (B) is not present or is present in very small amounts, ie. from 0 to 0.5% by weight, in the detergent formulation.

Component (C), which is of less importance for the effect, according to the invention, of the detergent formulation, is preferably present in amounts of from 0.05 to 2% by weight, in particular from 0.1 to 1% by weight, or can be omitted altogether.

In a preferred embodiment, component (D) comprises those compounds I in which R is a radical having at least 5 carbon atoms.

In a particularly preferred embodiment, component (D) comprises those glycine-N,N-diacetic acid derivatives I in which R is linear or branched unsubstituted $C_5$- to $C_{20}$-alkyl or $C_5$- to $C_{20}$-alkenyl, which may be interrupted by up to 5 nonadjacent oxygen and/or nitrogen atoms; said nitrogen atoms may carry hydrogen or $C_1$- to $C_8$-alkyl groups. Compounds I are used in the form of the free acids or their alkali metal, alkaline earth metal, ammonium and substituted ammonium salts. Salts of this type which are especially suitable are the sodium, potassium and ammonium salts, in particular the trisodium, tripotassium and triammonium salts, and also organic triamine salts having a tertiary nitrogen atom.

Particularly suitable parent bases for the organic amine salts are tertiary amines, such as trialkylamines having from 1 to 6 carbon atoms in the alkyl moiety, eg. trimethyl- and triethylamine, methyldiethylamine or tricyclohexylamine, and trialkanolamines having 2 or 3 carbon atoms in the alkanol radical, preferably triethanolamine, tri-n-propanolamine or triisopropanolamine.

Alkaline earth metal salts which may be used are, in particular, the calcium and magnesium salts.

It is possible to employ the racemates of compounds I or the two enantiomers with respect to the α-carbon atom in the glycine backbone.

In addition to methyl, suitable linear or branched alk(en)yl radicals as R are $C_2$- to $C_{30}$-alkyl and -alkenyl, particularly linear radicals derived from saturated or unsaturated fatty acids. Examples of individual R radicals are: ethyl, n-propyl, isopropyl, n-butyl, isobutyl, sec-butyl, tert-butyl, n-pentyl, isopentyl, tert-pentyl, neopentyl, n-hexyl, n-heptyl, 3-heptyl (derived from 2-ethylhexanoic acid), n-octyl, isooctyl (derived from isononanoic acid), n-nonyl, n-decyl, n-undecyl, n-dodecyl, isododecyl (derived from isotridecanoic acid), n-tridecyl, n-tetradecyl, n-pentadecyl, n-hexadecyl, n-heptadecyl, n-octadecyl, n-nonadecyl, n-eicosyl and n-heptadecenyl (derived from oleic acid). R can also be a mixture, in particular one derived from naturally occurring fatty acids and from technical-grade acids produced synthetically, for example by the oxo synthesis.

The $C_1$- to $C_{12}$-alkylene bridges A are especially polymethylene groups of the formula $—(CH_2)_t—$, where t is a number from 2 to 12, in particular from 2 to 8, ie. 1,2-ethylene, 1,3-propylene, 1,4-butylene, pentamethylene, hexamethylene, heptamethylene, octamethylene, nonamethylene, decamethylene, undecamethylene and dodecamethylene. Hexamethylene, octamethylene, 1,2-ethylene and 1,4-butylene are particularly preferred. However, branched $C_1$- to $C_{12}$-alkylene groups can also occur, eg. $—CH_2CH(CH_3)CH_2—$, $—CH_2C(CH_3)_2CH_2—$, $—CH_2CH(C_2H_5)—$or $—CH_2CH(CH_3)—$.

The $C_1$- to $C_{30}$-alkyl and $C_2$- to $C_{30}$-alkenyl groups can carry up to 5, in particular up to 3, additional substituents of said type and be interrupted by up to 5, in particular up to 3, nonadjacent oxygen atoms and/or nitrogen atoms. Examples of such substituted alk(en)yl groups are $—CH_2OH$, $—CH_2CH_2OH$, $—CH_2—CH_2—O—CH_3$, $—CH_2CH_2—O—CH_2CH_2—O—CH_3$, $—CH_2—O—CH_2CH_3$, $—CH_2—O—CH_2CH_2—OH$, $—CH_2—CHO$, $—CH_2—OPh$, $—CH_2—N(CH_3)_2$, $—CH_2—N(CH_3)—CH_3$, $—CH_2—COOCH_3$ or $—CH_2CH_2—COOCH_3$. Substituted alk(en)yl groups of the formula $—CH_2CH_2—O—R'$, where R' is as defined for R, are also of interest.

Particularly suitable alkoxylate groups are those in which m and n are each numbers from 0 to 30, especially from 0 to 15. $A^1$ and $A^2$ are groups derived from butylene oxide and, especially, from propylene oxide and from ethylene oxide. Pure ethoxylates and pure propoxylates are of particular interest, although ethylene oxide-propylene oxide block structures may also occur.

Suitable five- or six-membered unsaturated or saturated heterocyclic rings having up to three heteroatoms from the group consisting of nitrogen, oxygen and sulfur, which may, in addition, be benzo-fused and substituted by the designated radicals, are:

Tetrahydrofuran, furan, tetrahydrothiophene, thiophene, 2,5-dimethylthiophene, pyrrolidine, pyrroline, pyrrole, isoxazole, oxazole, thiazole, pyrazole, imidazoline, imidazole, 1,2,3-triazolidine, 1,2,3- and 1,2,4-triazole, 1,2,3-, 1,2,4- and 1,2,5-oxadiazole, tetrahydropyran, dihydropyran, 2H- and 4H-pyran, piperidine, 1,3- and 1,4-dioxane, morpholine, pyrazane, pyridine, α-, β- and γ-picoline, α- and γ-picoline, pyrimidine, pyridazine, pyrazine, 1,2,5-oxathiazine, 1,3,5-, 1,2,3- and 1,2,4-triazine, benzofuran, thionaphthene, indoline, indole, isoindoline, benzoxazole, indazole, benzimidazole, chroman, isochroman, 2H- and 4H-chromene, quinoline, isoquinoline, 1,2,3,4-tetrahydroisoquinoline, cinnoline, quinazoline, quinoxaline, phthalazine and benzo-1,2,3-triazine.

N—H groups in said heterocyclic rings should, where possible, be in derivatized form, for example as N-alkyl.

If there is any substitution on the phenyl or heterocyclic rings, there are preferably two (identical or different) substituents or, in particular, a single substituent.

Examples of alkyl groups R carrying unsubstituted or substituted phenylalkyl groups and heterocyclic rings are benzyl, 2-phenylethyl, 3-phenylpropyl, 4-phenylbutyl, o-, m- or p-hydroxybenzyl, o-, m- or p-carboxybenzyl, o-, m- or p-sulfobenzyl, o-, m- or p-methoxy- or -ethoxycarbonylbenzyl, 2-furylmethyl, N-methyl-4-piperidinylmethyl or 2-, 3- or 4-pyridinylmethyl.

If there is any substitution on the phenyl or heterocyclic rings, the substituents are preferably groups which confer solubility in water, such as hydroxyl groups, carboxyl groups or sulfo groups.

Examples of the $C_1$- to $C_4$-, $C_1$- to $C_{12}$- and $C_1$- to $C_{20}$-alkyl groups given as substituents also include the corresponding aforementioned radicals for R.

Component (D) is preferably present in the textile detergent formulation according to the invention in an amount of from 2 to 30% by weight, in particular from 5 to 25% by weight.

In a preferred embodiment, when component (B) is present in the solid textile detergent formulation according to the invention, the weight ratio of (D) glycine-N,N-diacetic acid derivatives I to (B) alumosilicates or silicates is from 50:1 to 1:5, preferably from 40:1 to 1:2. The detergent formulation according to the invention is particularly effective in this ratio range.

In a further preferred embodiment, the solid textile detergent formulation according to the invention comprises two or more glycine-N,N-diacetic acid derivatives of the formula I. The present mixture of the glycine-N,N-diacetic acid derivatives I consists in this case in particular of two or three or four or five components or main components. Such mixtures are particularly effective in the solid detergent formulation according to the invention if they consist of glycine-N,N-diacetic acid derivatives I in which the radicals R are chosen from branched and/or linear $C_1$-$C_{30}$-alkyl groups, especially branched and/or linear $C_1$-$C_{15}$-alkyl groups. To produce said mixture, the glycine-N,N-diacetic acid derivatives I can be incorporated into the textile detergent formulation individually or equally as a preprepared mixture. Such a last-named mixture from glycine-N,N-diacetic acid derivatives I can be prepared by mixing the individual components, but it can also be formed directly in the synthesis of the compound I. Examples thereof which may be mentioned are the products of the hydroformylation of $\alpha$-olefin mixtures (oxo synthesis) with subsequent reaction of this mixture of linear and branched aldehydes of varying carbon chain length to give the corresponding glycine-N,N-diacetic acid derivatives.

It is observed that the described mixtures of glycine-N,N-diacetic acid derivatives are particularly effective not only in the solid textile detergent formulation according to the invention, but generally in solid textile detergent formulations, for example in a formulation which comprises from 1 to 60% by weight (preferably from 10 to 45% by weight) of inorganic builders based on crystalline or amorphous aluminosilicates, crystalline or amorphous silicates, carbonates and/or phosphates, from 0.1 to 25% by weight (preferably from 3 to 10% by weight) of said mixture of glycine-N,N-diacetic acid derivatives I, from 1 to 40% by weight (preferably from 5 to 15% by weight) of anionic surfactants, from 0.5 to 30% by weight (preferably from 3 to 12% by weight) of nonionic surfactants and optionally from 0.5 to 20% by weight (preferably from 1 to 12% by weight) of other organic cobuilders in the form of low molecular weight, oligomeric or polymeric carboxylic acids or phosphonic acids or salts thereof. In addition, it is of course also possible for other customary components, such as bleaches, bleach activators, enzymes etc. to be present in the amounts customary for this purpose. Solid textile detergent formulations of this type are described, for example, in WO-A 97/19159.

Examples of suitable anionic surfactants (E) are fatty alcohol sulfates of fatty alcohols having from 8 to 22, preferably from 10 to 18, carbon atoms, eg. $C_9$- to $C_{11}$-alcohol sulfates, $C_{12}$- to $C_{14}$-alcohol sulfates, $C_{12}$- to $C_{18}$-alcohol sulfates, lauryl sulfate, cetyl sulfate, myristyl sulfate, palmityl sulfate, stearyl sulfate and tallow fatty alcohol sulfate.

Further suitable anionic surfactants are sulfated ethoxylated $C_8$- to $C_{22}$-alcohols (alkyl ether sulfates) and their soluble salts. Compounds of this type are prepared, for example, by firstly alkoxylating a $C_8$- to $C_{22}$-, preferably a $C_{10}$- to $C_{18}$-, alcohol, eg. a fatty alcohol, and subsequently sulfating the alkoxylation product. For the alkoxylation, it is preferable to use ethylene oxide, 1 to 50 mol, preferably 1 to 20 mol of ethylene oxide being employed per mole of alcohol. It is, however, also possible to alkoxylate the alcohols using propylene oxide alone or, if desired, together with butylene oxide. Also suitable are those alkoxylated $C_8$- to $C_{22}$-alcohols which contain ethylene oxide and propylene oxide or ethylene oxide and butylene oxide or ethylene oxide and propylene oxide and butylene oxide. The alkoxylated $C_8$- to $C_{22}$-alcohols can contain the ethylene oxide, propylene oxide and butylene oxide units in the form of blocks or in random distribution. Depending on the nature of the alkoxylation catalyst, alkyl ether sulfates of broad or narrow alkylene oxide homolog distribution can be obtained.

Further suitable anionic surfactants are alkanesulfonates, such as $C_8$- to $C_{24}$-, preferably $C_{10}$- to $C_{18}$-, alkanesulfonates, and also soaps, for example the Na and K salts of $C_8$- to $C_{24}$-carboxylic acids.

Further suitable anionic surfactants are linear $C_8$- to $C_{20}$-alkylbenzenesulfonates ("LAS"), preferably linear $C_9$- to $C_{13}$-alkylbenzenesulfonates and -alkyltoluenesulfonates.

Further suitable anionic surfactants (E) are $C_8$- to $C_{24}$-olefinsulfonates and -disulfonates, which may also be mixtures of alkene- and hydroxyalkanesulfonates or -disulfonates, alkyl ester sulfonates, sulfonated polycarboxylic acids, alkylglycerolsulfonates, fatty acid glycerol ester sulfonates, alkylphenol polyglycol ether sulfates, paraffinsulfonates having from about 20 to about 50 carbon atoms (based on paraffin mixtures or paraffin obtained from natural sources), alkyl phosphates, acyl isethionates, acyl taurates, acyl methyltaurates, alkylsuccinic acids, alkenylsuccinic acids or their monoesters or monoamides, alkylsulfosuccinic acids or their amides, mono- and diesters of sulfosuccinic acids, acyl sarcosinates, sulfated alkyl polyglucosides, alkylpolyglycol carboxylates and hydroxyalkyl sarcosinates.

The anionic surfactants are preferably added to the detergent in the form of salts. Suitable cations in these salts are alkali metal ions, such as sodium, potassium and lithium and ammonium salts, for example hydroxyethylammonium, di(hydroxyethyl)ammonium and tri(hydroxyethyl) ammonium salts.

Component (E) is preferably present in the novel textile detergent formulation in an amount of from 0.1 to 40% by weight, in particular from 1 to 30% by weight, especially from 5 to 20% by weight.

It is possible to use individual anionic surfactants or a combination of different anionic surfactants. It is possible to use anionic surfactants from only one class, for example only fatty alcohol sulfates or only alkylbenzenesulfonates, or mixtures of surfactants from different classes, eg. a mixture of fatty alcohol sulfates and alkylbenzenesulfonates.

Glycine-N,N-diacetic acid derivatives I have, in addition, a surfactant character and, as surface-active substances, can take on the function of anionic surfactants and replace them completely or partially in terms of quantity in the detergent formulation. It is thus possible to prepare yet more highly concentrated formulations.

Accordingly, in a further preferred embodiment, the novel solid textile detergent formulation contains as component (E) only from 0 to 6% by weight, in particular from 0 to 4% by weight, especially from 0.1 to 4% by weight, of anionic surfactants having one or more sulfate groups, one or more sulfonate groups, one or more phosphate groups or one or two carboxylate groups (these are taken to mean essentially the aforementioned anionic surfactants).

Examples of suitable nonionic surfactants (F) are alkoxylated $C_8$- to $C_{22}$-alcohols, such as fatty alcohol alkoxylates or oxo alcohol alkoxylates. The alkoxylation can be carried out using ethylene oxide, propylene oxide and/or butylene oxide. Surfactants which can be used are all the alkoxylated alcohols which contain at least two adducted molecules of one of the aforementioned alkylene oxides. Also suitable are block polymers of ethylene oxide, propylene oxide and/or butylene oxide or addition products which contain said alkylene oxides in random distribution. From 2 to 50, preferably from 3 to 20, mol of at least one alkylene oxide are used per mole of alcohol. The alkylene oxide used is preferably ethylene oxide. The alcohols preferably have 10 to 18 carbon atoms. Depending on the type of alkoxylation catalyst, it is possible to obtain alkoxylates with a broad or narrow alkylene oxide homolog distribution.

A further class of suitable nonionic surfactants comprises alkylphenol alkoxylates, such as alkylphenol ethoxylates having $C_6$- to $C_{14}$-alkyl chains and from 5 to 30 mol of alkylene oxide units.

Another class of nonionic surfactants comprises alkyl polyglucosides having from 8 to 22, preferably from 10 to 18 carbon atoms in the alkyl chain. These compounds usually contain from 1 to 20, preferably from 1.1 to 5, glucoside units.

Another class of nonionic surfactants comprises N-alkylglucamides having the structures

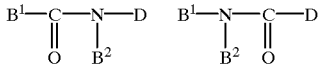

where $B^1$ is $C_6$- to $C_{22}$-alkyl, $B^2$ is hydrogen or $C_1$- to $C_4$-alkyl and D is polyhydroxyalkyl having from 5 to 12 carbon atoms and at least 3 hydroxy groups. Preferably, $B^1$ is $C_{10}$- to $C_{18}$-alkyl, $B^2$ is $CH_3$ and D is a $C_5$- or $C_6$ radical. Such compounds are obtained, for example, by acylating reductively aminated sugars using acid chlorides of $C_{10}$- to $C_{18}$-carboxylic acids.

Further suitable nonionic surfactants are the terminally-capped fatty acid amide alkoxylates, known from WO-A 95/11225, of the formula $$R^1—CO—NH—(CH_2)_y—O—(A^1O)_x—R^2$$

where $R^1$ is $C_5$- to $C_{21}$-alkyl or alkenyl, $R^2$ is $C_1$- to $C_4$-alkyl, $A^1$ is $C_2$- to $C_4$-alkylene, y is 2 or 3 and x is from 1 to 6.

Examples of such compounds are the reaction products of n-butyltriglycolamine of the formula $H_2N—(CH_2—CH_2—O)_3—C_4H_9$ and methyl dodecanoate or the reaction products of ethyltetraglycolamine of the formula $H_2N—(CH_2—CH_2—O)_4—C_2H_5$ and a commercially available mixture of saturated $C_8$- to $C_{18}$-fatty acid methyl esters.

Further suitable nonionic surfactants (F) are block copolymers of ethylene oxide, propylene oxide and/or butylene oxide (Pluronic® and Tetronic® grades from BASF), polyhydroxy- or polyalkoxyfatty acid derivatives, such as polyhydroxyfatty acid amides, N-alkoxy-or N-aryloxypolyhydroxyfatty acid amides, fatty acid amide ethoxylates, in particular terminally-capped ones, and also fatty acid alkanolamide alkoxylates.

Component (F) is preferably present in the novel textile detergent formulation in an amount of from 1 to 40% by weight, in particular from 3 to 30% by weight, especially from 5 to 25% by weight.

It is possible to use individual nonionic surfactants or a combination of different nonionic surfactants. It is possible to use nonionic surfactants from only one class, in particular only alkoxylated $C_8$- to $C_{22}$-alcohols, or mixtures of surfactants from different classes.

In a preferred embodiment, the novel textile detergent formulation comprises, in addition to the builder component (D), from 0.05 to 10% by weight, in particular from 1 to 5% by weight, of organic cobuilders (G) in the form of low molecular weight, oligomeric or polymeric carboxylic acids, in particular polycarboxylic acids, or phosphonic acids or their salts, in particular Na or K salts.

Examples of suitable low molecular weight carboxylic acids or phosphonic acids for (G) are:

phosphonic acids, for example 1-hydroxyethane-1,1-diphosphonic acid, aminotris(methylenephosphonic acid), ethylenediaminetetra(methylenephosphonic acid), hexamethylenediaminetetra(methylenephosphonic acid) and diethylenetriaminepenta(methylenephosphonic acid);

$C_4$- to $C_{20}$-di-, -tri- and -tetracarboxylic acids, for example succinic acid, propanetricarboxylic acid, butanetetracarboxylic acid, cyclopentanetetracarboxylic acid and alkyl- and alkenylsuccinic acids having $C_2$- to $C_{16}$-alkyl or -alkenyl radicals;

$C_4$- to $C_{20}$-hydroxycarboxylic acids, for example malic acid, tartaric acid, gluconic acid, glutaric acid, citric acid, lactobionic acid and sucrosemono-, di- and tricarboxylic acid;

aminopolycarboxylic acids, for example nitrilotriacetic acid, β-alaninediacetic acid, ethylenediaminetetraacetic acid, serinediacetic acid, isoserinediacetic acid, alkylethylenediamine triacetate, N,N-bis(carboxymethyl)glutamic acid, ethylenediaminedisuccinic acid and N-(2-hydroxyethyl)iminodiacetic acid.

Examples of suitable oligomeric or polymeric carboxylic acids for (G) are:

Oligomaleic acids, as described for example in EP-A 451508 and EP-A 396303;

co- and terpolymers of unsaturated $C_4$–$C_8$-dicarboxylic acids, possible copolymerized comonomers being monoethylenically unsaturated monomers from group (i) in amounts of up to 95% by weight, from group (ii) in amounts of up to 60% by weight and from group (iii) in amounts of up to 20% by weight.

Examples of suitable unsaturated $C_4$–$C_8$-dicarboxylic acids in this context are maleic, fumaric, itaconic and citraconic acid. Preference is given to maleic acid.

Group (i) includes monoethylenically unsaturated $C_3$–$C_8$-monocarboxylic acids, for example acrylic, methacrylic, crotonic and vinylacetic acid. From group (i), preference is given to acrylic and methacrylic acid.

Group (ii) includes monoethylenically unsaturated $C_2$–$C_{22}$-olefins, vinyl alkyl ethers having $C_1$–$C_8$-alkyl groups, styrene, vinyl esters of $C_1$-$C_8$-carboxylic acids, (meth)acrylamide and vinylpyrrolidone. From group (ii), preference is given to $C_2$–$C_6$-olefins, vinyl alkyl ethers having $C_1$-$C_4$-alkyl groups, vinyl acetate and vinyl propionate.

Group (iii) includes (meth)acrylic esters of $C_1$- to $C_8$-alcohols, (meth)acrylonitrile, (meth)acrylamides of $C_1$-$C_8$-amines, N-vinylformamide and N-vinylimidazole.

If the polymers of group (ii) contain copolymerized vinyl esters, they may also, in whole or in part, have been hydrolyzed to give vinyl alcohol structural units. Suitable co- and terpolymers are known from U.S. Pat. No. 3,887,806 and DE-A 43 13 909, for example.

Suitable copolymers of dicarboxylic acids for component (G) are preferably the following:

copolymers of maleic acid and acrylic acid in a weight ratio of from 10:90 to 95:5, particularly preferably those in the weight ratio of from 30:70 to 90:10 having molar masses of from 1000 to 150,000;

terpolymers of maleic acid, acrylic acid and a vinyl ester of a $C_1$-$C_3$-carboxylic acid in a weight ratio of from 10 (maleic acid):90 (acrylic acid+vinyl ester) to 95 (maleic acid):10 (acrylic acid+vinyl ester), it being possible for the weight ratio of acrylic acid to the vinyl ester to vary from 30:70 to 70:30; copolymers of maleic acid with $C_2$–$C_8$-olefins in a molar ratio of from 40:60 to 80:20, particular preference being given to copolymers of maleic acid with ethylene, propylene or isobutene in a molar ratio of 50:50.

Graft polymers of unsaturated carboxylic acids on low molecular weight carbohydrates or hydrogenated carbohydrates, cf. U.S. Pat. No. 5,227,446, DE-A 44 15 623 and DE-A 43 13 909, are likewise suitable as component (G).

Examples of suitable unsaturated carboxylic acids in this context are maleic, fumaric, itaconic, citraconic, acrylic, methacrylic, crotonic and vinylacetic acid and also mixtures of acrylic acid and maleic acid, which are grafted on in amounts of from 40 to 95% by weight, based on the component to be grafted.

For modification it is additionally possible for up to 30% by weight, based on the component to be grafted, of further monoethylenically unsaturated monomers to be copolymerized. Suitable modifying monomers are the aforementioned monomers of groups (ii) and (iii).

Suitable graft bases are degraded polysaccharides, for example acidic or enzymatically degraded starches, inulins or cellulose, protein hydrolyzates and reduced (hydrogenated or reductively aminated) degraded polysaccharides, for example mannitol, sorbitol, aminosorbitol and N-alkylglucamine, and also polyalkylene glycols having molar masses of up to $M_w$=5000, for example polyethylene glycols, ethylene oxide-propylene oxide or ethylene oxide-butylene oxide or ethylene oxide-propylene oxide-butylene oxide block copolymers and alkoxylated mono- or polyhydric $C_1$-$C_{22}$-alcohols, cf. U.S. Pat. No. 5,756,456.

Polyglyoxylic acids suitable as component (G) are described, for example, in EP-B 001 004, U.S. Pat. No. 5,399,286, DE-A 41 06 355 and EP-A 656 914. The end groups of the polyglyoxylic acids can have different structures.

Polyamidocarboxylic acids and modified polyamidocarboxylic acids suitable as component (G) are known, for example, from EP-A 454 126, EP-B 511 037, WO-A 94/01486 and EP-A 581 452.

Component (G) can also be, in particular, polyaspartic acids or cocondensates of aspartic acid with other amino acids, $C_4$–$C_{25}$-mono- or -dicarboxylic acids and/or $C_4$–$C_{25}$-mono- or -diamines. Particular preference is given to polyaspartic acids which have been prepared in phosphorus-containing acids and modified with $C_6$–$C_{22}$-mono- or -dicarboxylic acids or with $C_6$–$C_{22}$-mono- or -diamines.

Component (G) can also be iminodisuccinic acid, oxydisuccinic acid, aminopolycarboxylates, alkylpolyaminocarboxylates, aminopolyalkylenephosphonates, polyglutamates, hydrophobically modified citric acid, for example agaric acid, poly-α-hydroxyacrylic acid, N-acylethylenediaminetriacetates, such as lauroylethylenediaminetriacetate, and alkylamides of ethylenediaminetetraacetic acid, such as EDTA-tallow amide.

Furthermore, it is also possible to use oxidized starches as organic cobuilders.

In a further preferred embodiment, the novel textile detergent formulation additionally comprises from 0.5 to 40% by weight, in particular from 8 to 35% by weight, especially from 13 to 30% by weight, of bleaching agents (H) in the form of percarboxylic acids, for example diperoxododecanedicarboxylic acid, phthalimidopercaproic acid or monoperoxophthalic acid or -terephthalic acid, adducts of hydrogen peroxide with inorganic salts, for example sodium perborate monohydrate, sodium perborate tetrahydrate, sodium carbonate perhydrate or sodium phosphate perhydrate, adducts of hydrogen peroxide with organic compounds, for example urea perhydrate, or of inorganic peroxo salts, for example alkali metal persulfates, or alkali metal peroxodisulfates, where appropriate, in combination with from 0.01 to 15% by weight, in particular from 0.5 to 9% by weight, of bleach activators (J). In the case of color detergents, the bleaching agent (H) (if present) is normally employed without bleach activator (J); in other cases, bleach activators (J) are usually also present.

Suitable bleach activators (J) include:

polyacylated sugars, for example pentaacetylglucose;

acyloxybenzenesulfonic acids and their alkali metal and alkaline earth metal salts, for example sodium p-nonanoyloxybenzenesulfonate or sodium p-benzoyloxybenzenesulfonate;

N,N-diacylated and N,N,N',N'-tetraacylated amines, for example N,N,N',N'-tetraacetylmethylenediamine and -ethylenediamine (TAED), N,N-diacetylaniline, N,N-diacetyl-p-toluidine or 1,3-diacylated hydantoins, such as 1,3-diacetyl-5,5-dimethylhydantoin;

N-alkyl-N-sulfonylcarbonamides, for example N-methyl-N-mesylacetamide or N-methyl-N-mesylbenzamide;

N-acylated cyclic hydrazides, acylated triazoles or urazoles, for example monoacetylmaleic hydrazide;

O,N,N-trisubstituted hydroxylamines, for example O-benzoyl-N,N-succinylhydroxylamine, O-acetyl-N,N-succinylhydroxylamine or O,N,N-triacetylhydroxylamine;

N,N'-diacylsulfurylamides, for example N,N'-dimethyl-N,N'-diacetylsulfurylamide or N,N'-diethyl-N,N'-dipropionylsulfurylamide;

acylated lactams, for example acetylcaprolactam, carbonylbiscaprolactam, octanoylcaprolactam or benzoylcaprolactam;

anthranil derivatives, for example 2-methylanthranil or 2-phenylanthranil;

triacyl cyanurates, for example triacetyl cyanurate or tribenzoyl cyanurate;

oxime esters and bisoxime esters, for example O-acetylacetone oxime or bisisopropylimino carbonate;

carboxylic anhydrides, for example acetic anhydride, benzoic anhydride, m-chlorobenzoic anhydride or phthalic anhydride;

enol esters, for example isopropenyl acetate;

1,3-diacyl-4,5-diacyloxyimidazolines, for example 1,3-diacetyl-4,5-diacetoxyimidazoline;

tetraacetylglycoluril and tetrapropionylglycoluril;

diacylated 2,5-diketopiperazines, for example 1,4-diacetyl-2,5-diketopiperazine;

ammonium-substituted nitriles, for example N-methylmorpholiniumacetonitrile methylsulfate;

acylation products of propylenediurea and 2,2-dimethylpropylenediurea, for example tetraacetylpropylenediurea;

α-acyloxypolyacylmalonamides, for example α-acetoxy-N,N'-diacetylmalonamide;

diacyldioxohexahydro-1,3,5-triazines, for example 1,5-diacetyl-2,4-dioxohexahydro-1,3,5-triazine;

benz-(4H)1,3-oxazin-4-ones having alkyl radicals, for example methyl, or aromatic radicals, for example phenyl, in the 2-position.

The described bleaching system comprising bleaching agents and bleach activators may, if desired, also contain bleach catalysts. Examples of suitable bleach catalysts are quaternized imines and sulfoneimines, which are described, for example, in U.S. Pat. No. 5,360,569 and EP-A 453 003. Particularly effective bleach catalysts are manganese complexes, which are described, for example, in WO-A 94/21777. Where used, such compounds are incorporated into the detergent formulations in amounts of up to 1.5% by weight, in particular of up to 0.5% by weight; in the case of very active manganese complexes, amounts of up to 0.1% by weight are used.

In addition to the described bleaching system comprising bleaching agents, bleach activators and, if required, bleach catalysts, it is also possible to use systems having enzymatic peroxide release or photoactivated bleaching systems for the novel textile detergent formulation.

In another preferred embodiment, the novel textile detergent formulation additionally comprises from 0.05 to 4% by weight of enzymes (K). Enzymes which are preferably used in detergents are proteases, amylases, lipases and cellulases. Preferred quantities of the enzymes are from 0.1 to 1.7% by weight, in particular from 0.2 to 1.2% by weight, of the formulated enzyme. Examples of suitable proteases are Savinase and Esperase (manufacturer: Novo Nordisk). An example of a suitable lipase is Lipolase (manufacturer: Novo Nordisk). An example of a suitable cellulase is Celluzyme (manufacturer: Novo Nordisk). It is also possible to use peroxidases to activate the bleaching system. It is possible to use individual enzymes or a combination of different enzymes. If required, the novel textile detergent formulation can also contain enzyme stabilizers, for example calcium propionate, sodium formate or boric acids or salts thereof, and/or antioxidants.

In addition to said main components (A) to (K), the novel textile detergent formulation may also contain the following further customary additives in the amounts customary for this purpose:

cationic surfactants, usually in an amount up to 25% by weight, preferably 3 to 15% by weight, for example $C_8$- to $C_{16}$-dialkyldimethylammonium halides, dialkoxydimethylammonium halides or imidazolinium salts having a long-chain alkyl radical;

amphoteric surfactants, usually in an amount up to 15% by weight, preferably from 2 to 10% by weight, for example derivatives of secondary or tertiary amines, for example $C_{12}$- to $C_{18}$-alkylbetaines or $C_{12}$- to $C_{18}$-alkylsulfobetaines or amine oxides, such as alkyldimethylamine oxides;

antiredeposition agents and soil release polymers (for example, polyesters of polyethylene oxides with ethylene glycol and/or propylene glycol and aromatic dicarboxylic acids or aromatic and aliphatic dicarboxylic acids, or polyesters of polyethylene oxides, terminally-capped at one end, with di- and/or polyhydric alcohols and dicarboxylic acids. Polyesters of this type are known, for example, from U.S. Pat. No. 3,557,039, GB-A-1 154 730, EP-A-0 185 427, EP-A-0 241 984, EP-A-0 241 985, EP-A-0 272 033 and U.S. Pat. No. 5,142,020. Further suitable soil release polymers are amphiphilic graft polymers or copolymers of vinyl esters and/or acrylic esters on polyalkylene oxides, cf. U.S. Pat. No. 4,746,456, U.S. Pat. No. 4,846,995, DE-A-3 711 299, U.S. Pat. No. 4,904,408, U.S. Pat. No. 4,846,994 and U.S. Pat. No. 4,849,126, or modified celluloses, for example methylcellulose, hydroxypropylcellulose or carboxymethylcellulose. Antiredeposition agents and soil release polymers are present in the detergent formulations in amounts of from 0.1 to 3.5% by weight, preferably of from 0.2 to 2.5% by weight, particularly preferably of from 0.3 to 2% by weight. Preferred soil release polymers are the graft polymers, known from U.S. Pat. No. 4,746,456, of vinyl acetate on polyethylene oxide of molar mass 2500 to 8000 in the weight ratio of from 1.2:1 to 3.0:1, and also commercially available polyethylene terephthalate/polyoxyethylene terephthalates of molar mass from 3000 to 25,000 comprising polyethylene oxides of molar mass from 750 to 5000 with terephthalic acid and ethylene oxide and a molar ratio of polyethylene terephthalate to polyoxyethylene terephthalate of from 8:1 to 1:1, and the block polycondensates, known from DE-A-44 03 866, which contain blocks of (a) ester units comprising polyalkylene glycols of molar mass 500 to 7500 and aliphatic dicarboxylic acids and/or monohydroxymonocarboxylic acids and (b) ester units comprising aromatic dicarboxylic acids and polyhydric alcohols. These amphiphilic block copolymers have molar masses of from 1500 to 25,000.);

color transfer inhibitors, for example homo- and copolymers of N-vinylpyrrolidone, of N-vinylimidazole, of N-vinyloxazolidone or of 4-vinylpyridine N-oxide with molar masses of from 15,000 to 100,000, and also crosslinked, finely divided polymers based on these monomers and having a particle size of from 0.1 to 500, preferably 0.1 to 250 μm;

nonsurfactant foam suppressants or foam inhibitors, for example organopolysiloxanes and mixtures thereof with microfine, possibly silanized silicic acid, and also paraffins, waxes, microcrystalline waxes and mixtures thereof with silanized silicic acid;

complexing agents (also in the function of organic cobuilders);

optical brighteners;

polyethylene glycols;

perfumes or fragrances;

fillers;

inorganic extenders, for example sodium sulfate;

formulation auxiliaries;

solubility improvers;

opacifiers and pearlizing agents;

dyes;

corrosion inhibitors;

peroxide stabilizers;

electrolytes.

The novel textile detergent formulation is solid, ie. is usually in powder or granule form or in the form of extrudates or tablets.

The novel pulverulent or granular detergents may contain up to 60% by weight of inorganic extenders. Sodium sulfate is usually used for this purpose. However, the content of extenders in the novel detergents is preferably low and is only up to 20% by weight, particularly preferably only up to 8% by weight, particularly in the case of compact or ultracompact detergents. The novel solid detergents may have various bulk densities in the range from 300 to 1300 g/l, in particular from 550 to 1200 g/l, especially 650 to 1100 g/l. Modern compact detergents generally have high bulk densities and are granular. To achieve the desired compaction of the detergents, it is possible to use the techniques customary in the art.

The textile detergent formulation of the invention is prepared and, if desired, packaged in accordance with customary methods.

The text below gives typical compositions of compact standard detergents and color detergents (the percentages are by weight; the data in brackets in the case of compositions (a) and (b) are preferred ranges):

(a) Composition of a compact standard detergent (pulverulent or granular)

| | | |
|---|---|---|
| 1–40% | (2–30%) | of at least one glycine-N,N-diacetic acid derivative (D) |
| 1–30% | (5–27%) | of at least one carbonate-based inorganic builder (A) |
| 0–8% | (1.5–8% or 0–0.5%) | of at least one inorganic builder based on crystalline or amorphous alumosilicates and/or cristalline or amorphous silicates (B) |
| 0–5% | (0.05–2%) | of at least one phosphate-based inorganic builder (C) |
| 0.1–40% | (1–30%) | of at least one anionic surfactant (E) |
| 0.5–50% | (1–40%) | of at least one nonionic surfactant (F) |
| 0–10% | (0.5–5%) | of at least one organic cobuilder (G) |
| 5–40% | (13–30%) | of an inorganic bleaching agent (H) |
| 0.01–15% | (0.5–9%) | of a bleach activator (J) |
| 0–1.5% | (0–0.5%) | of a bleach catalyst |
| 0–6% | (0.2–3%) | of a color transfer inhibitor |
| 0–3.5% | (0.2–2.5%) | of a soil release polymer |
| 0.05–4% | (0.1–1.7%) | of enzyme or enzyme mixture (K) |

Further customary additives:

sodium sulfate, completing agents, phosphonates, optical brighteners, perfume oils, foam suppressants, antiredeposition agents, bleaching agent stabilizers.

(b) Composition of color detergents (pulverulent or granular)

| | | |
|---|---|---|
| 1–40% | (2–30%) | of at least one glycine-N,N-diacetic acid derivative (D) |
| 1–30% | (5–27%) | of at least one carbonate-based inorganic builder (A) |
| 0–8% | (1.5–8% or 0–0.5%) | of at least one inorganic builder based on crystalline or amorphous alumosilicates and/or cristalline or amorphous silicates (B) |
| 0–5% | (0.05–2%) | of at least one phosphate-based inorganic builder (C) |
| 0.1–40% | (1–30%) | of at least one anionic surfactant (E) |
| 0.5–50% | (1–40%) | of at least one nonionic surfactant (F) |
| 0–10% | (0.5–5%) | of at least one organic cobuilder (G) |
| 0–15% | (0–5%) | of an inorganic bleaching agent (H) |
| 0.05–6% | (0.2–3%) | of a color transfer inhibitor |
| 0.1–2.5% | (0.1–1.5%) | of enzyme or enzyme mixture (K) |
| 0.1–3.5% | (0.2–2.5%) | of a soil release polymer |

Further customary additives:

sodium sulfate, complexing agents, phosphonates, optical brighteners, perfume oils, foam suppressants, antiredeposition agents, bleaching agent stabilizers

EXAMPLES

Unless stated otherwise, all percentages are by weight.

Determination of the inorganic deposits on the fabric (incrustation)

The detergent formulations described in Table 1 (DF 1 to 5) were used to wash a cotton test fabric. The washing conditions are given in Table 2. The number of washing cycles was 15, after which the ash content of the test fabric was determined by incineration at 700° C.

TABLE 1

| | DF 1 [%] | DF 2 [%] | DF 3 [%] | DF 4 [%] | DF 5 [%] |
|---|---|---|---|---|---|
| Lin. alkylbenzenesulfonate | 6.00 | 6.00 | 6.00 | 6.00 | |
| $C_{12}$- to $C_{18}$-alkyl sulfate | 2.00 | 2.00 | 2.00 | 2.00 | |
| $C_{13}$- to $C_{15}$-oxoalcohol × 7 EO | 7.00 | 7.00 | 7.00 | 7.00 | 7.00 |
| AGDA, Na salt | | 5.00 | 10.00 | 15.00 | 20.00 |
| Soap | 1.00 | 1.00 | 1.00 | 1.00 | |
| Silicate builder | 36.00 | 5.00 | | | |
| Sodium metasilicate × 5 $H_2O$ | 3.50 | | 3.50 | | |
| Sodium carbonate | 12.00 | 12.00 | 12.00 | 12.00 | 12.00 |
| Carboxymethyl cellulose | 1.50 | 1.50 | 1.50 | 1.50 | 1.50 |
| Sodium perborate monohydrate | 15.00 | 15.00 | 15.00 | 15.00 | 15.00 |
| TAED | 3.50 | 3.50 | 3.50 | 3.50 | 3.50 |
| Sodium sulfate | 3.00 | 3.00 | 3.00 | 3.00 | 3.00 |
| Water | 9.50 | 39.00 | 35.50 | 34.00 | 38.00 |

The abbreviations in Table 1 have the following meanings:

TAED: tetraacetylethylenediamine

AGDA: alkylglycine-N,N-diacetic acid of the formula I where R=a linear $C_7$-alkyl to $C_{15}$-alkyl The silicate builder content of detergent 1 (standard compact detergent for comparison purposes) was reduced from 36% to 5 and 0% (DF 2–5). 5, 10, 15 or 20% of AGDA (Na salt) were added. In order to be able to compare the results, the formulations were made up to 100% with water.

TABLE 2

| | |
|---|---|
| Washing conditions: | incrustation |
| Washing machine: | Launder-o-meter from Atlas, Chicago, USA |
| Liquor volume: | 250 ml |
| Washing duration: | 30 min. at 60° C. |
| Washing cycles: | 15 |
| Detergent concentration: | 4.5 g/l |
| Water hardness: | 4 mmol/l Ca:Mg = 4:1 |
| Liquor ratio: | 1:12.5 |
| Test fabric: | cotton fabric EMPA 211 (Eidgenössische Materialprüfungsanstalt, St. Gallen, Switzerland) |

Results:

TABLE 3

| Ex. | Detergent | 36% of Si builder | 0% of AGDA | Ash content [%] |
|---|---|---|---|---|
| 1 | DF 1 | Zeolite A | | 5.15 |
| 2 | DF 1 | Zeolite P | | 5.43 |
| 3 | DF 1 | SKS 6 | | 5.22 |
| 4 | DF 1 | Britesil H 20 | | 4.98 |

| Ex. | Detergent | 5% of Si builder | 5% of AGDA | Ash content [%] |
|---|---|---|---|---|
| 5 | DF 2 | Zeolite A | C 13-AGDA | 3.31 |
| 6 | DF 2 | Zeolite A | C 15-AGDA | 3.11 |

TABLE 3-continued

| | | | | |
|---|---|---|---|---|
| 7 | DF 2 | Zeolite P | C 10-AGDA | 3.64 |
| 8 | DF 2 | SKS 6 | C 11-AGDA | 3.70 |
| 9 | DF 2 | SKS 6 | C 14-AGDA | 3.38 |
| 10 | DF 2 | Britesil H 20 | C 13-AGDA | 3.20 |

| Ex. | Detergent | 0% of Si builder | 10% of AGDA | Ash content [%] |
|---|---|---|---|---|
| 11 | DF 3 | | C 8-AGDA | 3.51 |
| 12 | DF 3 | | C 10-AGDA | 3.19 |
| 13 | DF 3 | | C 13-AGDA | 2.53 |
| 14 | 3 | | C 15-AGDA | 2.47 |

| Example | Detergent | 0% of Si builder | 15% of AGDA | Ash content [%] |
|---|---|---|---|---|
| 15 | DF 4 | | C 7-AGDA | 2.99 |
| 16 | DF 4 | | C 11-AGDA | 2.38 |
| 17 | DF 4 | | C 13-AGDA | 1.74 |

TABLE 3-continued

| Example | Detergent | 0% of Si builder | 20% of AGDA | Ash content [%] |
|---|---|---|---|---|
| 18 | DF 5 | | C 9-AGDA | 2.80 |
| 19 | DF 5 | | C 13-AGDA | 2.08 |

The results show that detergent formulations DF 2 to 5, which contain a greatly reduced amount of silicate builders, or none at all, are clearly superior over the conventional detergent formulation DF 1 as regards their incrustation-inhibiting effect. The addition of cobuilders (G) can further reduce the ash content. The primary detergency of each of the formulations DF 2 to 5 is also better than the primary detergency of formulation DF 1.

TABLE 4

Table 4 lists, by way of example, compositions [in %] of modern novel compact detergent formulations A to S

| Constituents | A | B | C | D | E | F | G | H | I | J |
|---|---|---|---|---|---|---|---|---|---|---|
| Lin. alkylbenzenesulfonate | | | 9 | 3 | 8 | 1.5 | 6 | 11.5 | 4 | |
| C12-C18-Alkyl sulfate | 8 | 13 | 3 | 3 | 5 | 13 | | | 1.5 | 11 |
| C12-Fatty alcohol × 2 EO sulfate | | | | | | | | | | 4 |
| Alkylglycinediacetic acid, Na salt | 8 | 15 | 11.5 | 21 | 14 | 15 | 15 | 9 | 10 | 14 |
| C12-C18-Fatty alcohol × 4 EO | | | | | | | | | 6 | 6 |
| C12-C18-Fatty alcohol × 7 EO | 14 | 14 | | | | | | | | |
| C13-C15-Oxo alcohol × 7 EO | | | 10 | 10 | | 8 | 13 | 14 | | |
| C13-C15-Oxo alcohol × 11 EO | | | | | 9 | | | | | 6 |
| C16-C18-Glucamide | | | | | | | | | 6 | |
| C12-C14-Alkylpolyglucoside | | | | | | | | | | |
| C8-C18-Fatty acid methyltetraglycolamide | | | | | | | | | | |
| Soap | 3 | 3 | 1.5 | 1.5 | | 1 | | 1 | | 1 |
| Na metasilicate × 5.5 $H_2O$ | 2 | 3 | | 2 | | | | | | |
| Na silicate | | | | | 2 | | | 3.5 | | |
| Mg silicate | | | | | | 1.4 | | | | |
| Zeolite A | | | 6 | | | | | 3 | 7 | |
| Zeolite P | | | | 4 | | | | | | |
| Sheet silicate SKS 6 | | | | | | | | | | |
| Amorphous sodium disilicate | | | | | 2 | | | | | |
| Sodium carbonate | 20 | 17 | 20 | 17 | 18 | | 22 | 19 | 12 | 12 |
| Sodium hydrogencarbonate | | | | | | 13 | | | | |
| Sodium citrate | | | | | | 7 | | | 10 | 6 |
| TAED | 6 | 6 | 5 | 5 | 5 | 6 | 4.5 | 6 | 5.5 | 7 |
| Na perborate tetrahydrate | | | 21 | | 24 | | 28 | | 29 | |
| Na perborate monohydrate | | | | 21 | | | | 22 | | |
| Na percarbonate | 21 | 21 | | | | 22 | | | | 28 |
| Carboxymethyl cellulose | 2.5 | 1.5 | 2 | 2 | 3.5 | 1 | 3 | 1.5 | 1.8 | 2.1 |
| Soil release additive 1 | 1.2 | 1.2 | | 1.1 | | 0.7 | | | 0.7 | 0.7 |
| Soil release additive 2 | | | | | | | | | | |
| Lipase | | 0.3 | 0.7 | 0.4 | 0.3 | 0.3 | 0.7 | | 0.7 | 0.7 |
| Protease | 1 | 0.8 | 0.8 | 1 | 0.7 | 0.8 | 0.8 | | 0.7 | 0.7 |
| Cellulase | | 0.4 | | 0.4 | 0.4 | 0.4 | | | | |
| Amylase | | 0.3 | | | 0.4 | | | | | 0.3 |
| Sodium sulfate | 8 | 3 | 7 | 4 | 5 | 3.5 | 3 | 3.5 | 2.4 | |
| Incrustation inhibitor | 3 | | | | | 4 | | 4 | | |
| Phosphonate | | | | | | | | 0.2 | 0.2 | |
| Opt. brightener | 0.3 | 0.3 | 0.3 | 0.3 | | 0.3 | | | 0.3 | 0.3 |
| Color transfer inhibitor | | | | | | | | | | |
| Water | 2 | 0.2 | 2.2 | 3.3 | 2.7 | 1.4 | 4 | 1.8 | 2.2 | 0.2 |
| Total | 100.00 | 100.00 | 100.00 | 100.00 | 100.00 | 100.00 | 100.00 | 100.00 | 100.00 | 100.00 |

| Constituents | K | L | M | N | O | P | Q | R | S |
|---|---|---|---|---|---|---|---|---|---|
| Lin. alkylbenzenesulfonate | | | | | 4 | | 3 | | |
| C12-C18-Alkyl sulfate | 5 | 11 | 13 | 10 | 8 | 4 | 1 | | 2 |
| C12-Fatty alcohol × 2 EO sulfate | | | | | | | | | 1 |
| Alkylglycinediacetic acid, Na salt | 17 | 23 | 10 | 17 | 20 | 17 | 16 | 18 | 17 |
| C12-C18-Fatty alcohol × 4 EO | | | 6 | 6 | | | | | 8 |
| C12-C18-Fatty alcohol × 7 EO | | | | | | 16 | | | |

TABLE 4-continued

Table 4 lists, by way of example, compositions [in %] of modern novel compact detergent formulations A to S

| | | | | | | | | | |
|---|---|---|---|---|---|---|---|---|---|
| C13-C15-Oxo alcohol × 7 EO | 16 | 14 | | | 17 | | 14 | 15 | |
| C13-C15-Oxo alcohol × 11 EO | | | | | | | | | |
| C16-C18-Glucamide | | | | | | | | | 8 |
| C12-C14-Alkylpolyglucoside | | | 6 | | | | | | |
| C8-C18-Fatty acid methyltetraglycolamide | | | | 8 | | | | | |
| Soap | 1 | 3 | 2 | 3 | 3 | | 1.5 | | |
| Na metasilicate × 5.5 $H_2O$ | | 3 | 2 | 3 | 2 | 3 | | | 1.5 |
| Na silicate | | | | | | | | | |
| Mg silicate | | | | 1 | | | | | |
| Zeolite A | | | | | 2 | 3 | | | |
| Zeolite P | | | | | | | | | |
| Sheet silicate SKS 6 | 6 | | | | | | | | |
| Amorphous sodium disilicate | | | | | | | | | |
| Sodium carbonate | 17 | 17 | 19 | 17 | 20 | 19 | 21 | 20 | 15 |
| Sodium hydrogencarbonate | | | | | | | | | |
| Sodium citrate | | | | | | | | | 6 |
| TAED | 6 | 6 | 6 | 6 | | 6 | 5 | 5 | 7 |
| Na perborate tetrahydrate | | | | | | | 21 | | |
| Na perborate monohydrate | | | | | | | | 24 | |
| Na percarbonate | 22 | 21 | 21 | 21 | | 21 | | | 28 |
| Carboxymethyl cellulose | 1.5 | 1.5 | 1.5 | 1.5 | 3 | 1.5 | 2 | 3 | 2.1 |
| Soil release additive 1 | | | 0.7 | 0.7 | | 1.2 | | 1.1 | 0.7 |
| Soil release additive 2 | | | 0.7 | 0.8 | | | | | |
| Lipase | | | 0.7 | 0.7 | | 0.3 | | 0.3 | 0.7 |
| Protease | | | 0.7 | 0.7 | 1 | 0.8 | 1 | 1 | 0.7 |
| Cellulase | | | 0.3 | | | 0.4 | | 0.4 | |
| Amylase | | | | | | 0.3 | | 0.3 | 0.3 |
| Sodium sulfate | 6 | | 5 | | 8 | 3 | 10 | 6 | |
| Incrustation inhibitor | | | | | 6 | | | | |
| Phosphonate | | | 0.2 | | | | | | |
| Opt. brightener | | | 0.3 | 0.3 | | 0.3 | 0.3 | 0.3 | 0.3 |
| Color transfer inhibitor | | | | | 2.5 | | | | |
| Water | 2.5 | 0.5 | 4.9 | 3.3 | 3.5 | 3.2 | 4.2 | 5.6 | 1.7 |
| Total | 100.00 | 100.00 | 100.00 | 100.00 | 100.00 | 100.00 | 100.00 | 100.00 | 100.00 |

The abbreviations in Table 4 have the following meanings:

TAED: Tetraacetylethylenediamine

AGDA: Alkylglycinediacetic acid of the formula I where R=a linear $C_7$-alkyl to $C_{15}$-alkyl or a mixture of two or three alkylglycinediacetic acids of the formula I, for example R=methyl/tridecyl (molar ratio about 1:2), R=α-ethylpentyl/tridecyl (molar ratio about 1:1), R=heptyl/decyl/pentadecyl (molar ratio about 1:1:1) or R=dodecyl/tetradecyl (molar ratio about 2:1)

EO: Ethylene oxide

Color transfer inhibitor: Polyvinylpyrrolidone, poly-4-vinylpyridine N-oxide or vinylimidazole-vinylpyrrolidone copolymer Incrustation inhibitor: Acrylic acid-maleic acid copolymer Soil release additive 1: Polyethylene terephthalate/polyoxyethylene terephthalate in a molar ratio of 3:2; molar mass of the condensed polyethylene glycol is 4000, molar mass of the polyester is 10,000

Soil release additive 2: Graft polymer of vinyl acetate on polyethylene glycol having a molar mass of 8000.

We claim:

1. A solid textile detergent formulation, comprising (A) from 1 to 30% by weight of inorganic builders based on carbonates, (B) inorganic builders based on crystalline or amorphous aluminosilicates and/or crystalline or amorphous silicates in an amount ≦12% by weight, (C) from 0 to 5% by weight of inorganic builders based on phosphates, (D) from 1 to 40% by weight of one or more glycine-N, N-diacetic acid derivatives of the formula I

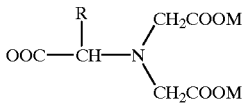

(I)

where

R is $C_1$- to $C_{30}$-alkyl or C2- to $C_{30}$-alkenyl, each of which is unsubstituted or substituted by up to 5 hydroxyl, sulfate, sulfonate, formyl, $C_1$- to $C_4$-alkoxy, phenoxy or $C_1$- to $C_4$-alkoxycarbonyl groups, and may be interrupted by up to 5 nonadjacent oxygen and/or nitrogen atoms, R is furthermore alkoxylate of the formula $—(CH_2)_k—O—(A^1O)_m—(A^2O)_n—Y$, where $A^1$ and $A^2$, independently of one another, are 1,2-alkylene having from 2 to 4 carbon atoms, Y is hydrogen, $C_1$- to $C_{12}$-alkyl, phenyl, $C_1$- to $C_4$-alkoxycarbonyl or sulfo, k is 1, 2 or 3, and m and n are each from 0 to 50, where the sum m+n must be at least 2, phenylalkyl having from 1 to 20 carbon atoms in the alkyl moiety, a five- or six-membered unsaturated or saturated heterocyclic ring having up to three heteroatoms from the group consisting of nitrogen, oxygen and sulfur, which may, in addition, be benzo-fused, where all the phenyl and heterocyclic rings given in the meanings for R are unsubstituted or substituted by up to three $C_1$- to $C_4$-alkyl, hydroxyl, carboxyl, sulfo or $C_1$- to $C_4$-alkoxycarbonyl groups, or is a radical of the formula

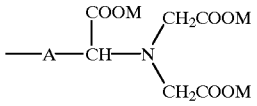

where A is a $C_1$- to $C_{12}$-alkylene bridge or a chemical bond, and

M is hydrogen, alkali metal, alkaline earth metal, ammonium or substituted ammonium in the corresponding stoichiometric quantities, as organic builder component, (E) from 0 to 40% by weight of anionic surfactants and (F) from 0.5 to 50% by weight of nonionic surfactants.

2. A solid textile detergent formulation, comprising (A) from 1 to 30% by weight of inorganic builders based on carbonates, (C) from 0 to 5% by weight of inorganic builders based on phosphates, (D) from 1 to 40% by weight of one or more glycine-N, N-diacetic acid derivatives of the formula I (I)

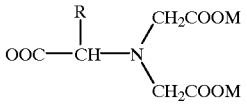

where

R is $C_1$- to $C_{30}$-alkyl or $C_2$- to $C_{30}$-alkenyl, each of which is unsubstituted or substituted by up to 5 hydroxyl, sulfate, sulfonate, formyl, $C_1$- to $C_4$-alkoxy, phenoxy or $C_1$- to $C_4$-alkoxycarbonyl groups, and may be interrupted by up to 5 nonadjacent oxygen and/or nitrogen atoms, R is furthermore alkoxylate of the formula $—(CH_2)_k—O—(A^1O)_m—(A^2O)_n—Y$, where $A^1$and $A^2$, independently of one another, are 1,2-alkylene having from 2 to 4 carbon atoms, Y is hydrogen, $C_1$- to $C_{12}$-alkyl, phenyl, $C_1$- to $C_4$-alkoxycarbonyl or sulfo, k is 1, 2 or 3, and m and n are each from 0 to 50, where the sum m+n must be at least 2, phenylalkyl having from 1 to 20 carbon atoms in the alkyl moiety, a five- or six-membered unsaturated or saturated heterocyclic ring having up to three heteroatoms from the group consisting of nitrogen, oxygen and sulfur, which may, in addition, be benzo-fused, where all the phenyl and heterocyclic rings given in the meanings for R are unsubstituted or substituted by up to three $C_1$- to $C_4$-alkyl, hydroxyl, carboxyl, sulfo or $C_1$- to $C_4$-alkoxycarbonyl groups, or is a radical of the formula

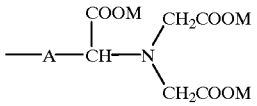

where A is a $C_1$- to $C_{12}$-alkylene bridge or a chemical bond, and

M is hydrogen, alkali metal, alkaline earth metal, ammonium or substituted ammonium in the corresponding stoichiometric quantities, as organic builder component, (E) from 0 to 40% by weight of anionic surfactants and (F) from 0.5 to 50% by weight of nonionic surfactants, wherein an inorganic builder based on crystalline or amorphous aluminosilicates and/or crystalline or amorphous silicates is not present.

3. The solid textile detergent formulation of claim 1, wherein said inorganic builder based on carbonates is present in an amount of from 5 to 27% by weight.

4. The solid textile detergent formulation of claim 2, wherein said inorganic builder based on carbonates is present in an amount of from 5 to 27% by weight.

5. A solid textile detergent formulation as claimed in claim 1, additionally comprising (G) from 0.05 to 10% by weight of organic cobuilders in the form of low molecular weight, oligomeric or polymeric carboxylic acids or phosphonic acids or salts thereof.

6. A solid textile detergent formulation as claimed in claim 1, additionally comprising (H) from 0.5 to 40% by weight of bleaching agents in the form of percarboxylic acids, adducts of hydrogen peroxide with inorganic salts or organic compounds or of inorganic peroxo salts and also, if desired, (J) from 0.01 to 15% by weight of bleach activators.

7. A solid textile detergent formulation as claimed in claim 1, additionally comprising (K) from 0.05 to 4% by weight of enzymes.

8. A solid textile detergent formulation as claimed in claim 1, comprising (B) from 1.5 to 8% by weight of inorganic builders based on alumosilicates or silicates.

9. A solid textile detergent formulation as claimed in claim 1, comprising (B) from 0 to 0.5% by weight of inorganic builders based on alumosilicates or silicates.

10. A solid textile detergent formulation as claimed in claim 1, in which the weight ratio of (D) glycine-N,N-diacetic acid derivatives I to (B) alumosilicates or silicates is, when component (B) is present, from 50:1 to 1:5.

11. A solid textile detergent formulation as claimed in claim 1, comprising as component (D) those glycine-N,N-diacetic acid derivatives I in which R is a radical having at least 5 carbon atoms.

12. A solid textile detergent formulation as claimed in claim 1, comprising as component (D) those glycine-N,N-diacetic acid derivatives I in which R is linear or branched unsubstituted $C_5$- to $C_{20}$-alkyl or $C_5$- to $C_{20}$-alkenyl, which may be interrupted by up to 5 nonadjacent oxygen and/or nitrogen atoms.

13. A solid textile detergent formulation as claimed in claim 1, comprising (E) from 0 to 6% by weight of anionic surfactants having one or more sulfate groups, one or more sulfonate groups, one or more phosphate groups or one or two carboxylate groups.

14. A solid textile detergent formulation as claimed in claim 1 having a bulk density of from 300 to 1300 g/l.

* * * * *